United States Patent [19]

Lawson et al.

[11] Patent Number: 4,563,608

[45] Date of Patent: Jan. 7, 1986

[54] GAS FLOW STABILIZED MEGAVOLT SPARK GAP FOR REPETITIVE PULSES

[75] Inventors: Robert N. Lawson; Martin W. O'Malley; Gerald J. Rohwein, all of Albuquerque, N. Mex.

[73] Assignee: The United States of America as represented by the United States Department of Energy, Washington, D.C.

[21] Appl. No.: 440,202

[22] Filed: Nov. 8, 1982

[51] Int. Cl.[4] ..... H01J 17/26; H01J 61/28

[52] U.S. Cl. ..... 313;231.71; 313/231.01

[58] Field of Search ..... 313/231.01, 231.31, 313/231.41, 362.1, 120, 231.71; 328/233; 315/111.01, 358, 498, 325

[56] References Cited

U.S. PATENT DOCUMENTS

| | | | |
|---|---|---|---|
| 3,447,013 | 5/1969 | Van Ornum et al. | 313/22 |
| 3,469,143 | 9/1969 | Van Ornum et al. | 313/622 |
| 3,474,278 | 10/1969 | Thouret et al. | 313/570 |
| 3,543,076 | 11/1970 | Haslund | 313/558 |
| 3,551,737 | 12/1970 | Sheets | 313/570 |
| 3,900,762 | 8/1975 | Sheer et al. | 315/111.01 |

OTHER PUBLICATIONS

Ramrus, Allen, "Development of 100 kV Multimegawatt Rep Rate Gas Switch", presented at 1978 Thirteenth Pulse Power Modulator Symposium, Buffalo, NY, USA, 20–22, Jun. 1978, pp. 88–93.

*Primary Examiner*—David K. Moore

*Attorney, Agent, or Firm*—George H. Libman; Albert Sopp; Judson R. Hightower

[57] ABSTRACT

A high voltage spark gap switch including a housing having first and second end walls being spaced apart by a predetermined distance. A first electrode is positioned on the first end wall and a second electrode is positioned on the second end wall. The first and second electrodes are operatively disposed relative to each other and are spaced apart by a predetermined gap. An inlet conduit is provided for supplying gas to the first electrode. The conduit includes a nozzle for dispersing the gas in the shape of an annular jet. The gas is supplied into the housing at a predetermined velocity. A venturi housing is disposed within the second electrode. An exhaust conduit is provided for discharging gas and residue from the housing. The gas supplied at the predetermined velocity to the housing through the inlet conduit and the nozzle in an annular shape traverses the gap between the first and second electrodes and entrains low velocity gas within the housing decreasing the velocity of the gas supplied to the housing and increasing the diameter of the annular shape. The venturi disposed within the second electrode recirculates a large volume of gas to clean and cool the surface of the electrodes.

6 Claims, 4 Drawing Figures

GAS FLOW STABILIZED MEGAVOLT SPARK GAP FOR REPETITIVE PULSES

The U.S. Government has rights in this invention pursuant to Contract No. DE-AC04-76DP00789 between the U.S. Department of Energy and Western Electric Company.

BACKGROUND OF THE INVENTION

1. Field of the Invention

The present invention relates to a high voltage spark gap switch wherein a gas insulated self-firing spark gap operates in the megavolt range.

2. Description of the Prior Art

A spark gap switch is useful in the output stages of a high voltage particle accelerator to switch the electrostatic energy stored on a pulse forming line (PFL) through the machine's diode. When an accelerator is repetitively pulsed at rates ranging from 1 to hundreds of pulses per second, the gas in the switch must completely recover its dielectric strength between pulses to withstand the subsequent PFL charge cycle voltage up to the self-fire level. The break-over of the spark gap must occur at identically the same voltage on each pulse. The condition of repeatable self-firing at a predetermined voltage is defined as stable spark gap operation.

The Sheets U.S. Pat. No. 3,551,737, discloses an electrode which has an opening therein and in which only a minor portion of the vortically flowing gas is drained from an arc chamber through the opening. The gas vortex stabilized radiation source includes electrodes 10, 11 and a powder gas source 33. Gas is supplied to the chamber 17 and is recirculated through the heat exchanger 22 and the pump 23 back into the chamber. The annular holes 24 generate a vortex effect to improve power handling capabilities. The vortex gas flow is designed to stabilize the arc discharge in the tube.

Thouret et al, U.S. Pat. No. 3,474,278, disclose an arc pressure lamp with an internal gas circulation having electrodes 18 and 48. Electrode 18 is hollow for the purpose of cooling the electrode assembly. The lamp disclosed by Thouret et al is designed to provide an intense steady light source.

The Van Ornum et al U.S. Pat. No. 3,469,143, discloses an electric arc light source having an undercut recessed anode. The anode includes a recess or opening 45 which provides the high efficiency and arc stability in addition to long electrode life at high power levels.

Van Ornum et al, U.S. Pat. No. 3,447,013, disclose a device substantially similar to U.S. Pat. No. 3,469,143. The electrode 10 includes a shroud 19 disposed around the surface thereof. The electrode 11 includes an opening through the central portion thereof. The device provides a vortex-stabilized radiation source wherein the arc is stable and readily controllable while major amounts of gas are drained from the peripheral region of the arc chamber for purposes of cooling the envelope.

Haslund, U.S. Pat. No. 3,543,076, discloses aerodynamic arc lamp electrodes. The arc lamp electrodes are aerodynamically shaped to provide an improved and stable light source at high power levels for an extended operating lifetime. A gas is circulated in a recirculating flow pattern which optimizes heat transfer, stabilizes the arc and controls deposition of vaporized electrode particles.

SUMMARY AND OBJECTS OF THE PRESENT INVENTION

It is an object of the present invention to provide a megavolt spark gap wherein the spark moves around on a pulse-to-pulse basis to equalize wear on the electrodes.

A further object of the present invention is to provide a gas-insulated high-voltage self-sparking spark gap switch for repetitive pulse applications.

A further object of the present invention is to provide a switch with improved breakdown-characteristics. The present invention requires much less gas flow through the switch to achieve proper self-firing operation.

A still further object of the present invention is to provide a switch wherein the gas flow is reduced thereby reducing the compressor power and hence, improving the overall system efficiency.

These and other objects of the present invention are achieved by providing a high voltage arc gap switch which is mounted within a housing having first and second end walls. A first electrode is positioned on the first end wall. A second electrode is positioned on the second end wall. The first and second electrodes are operatively disposed relative to each other and are spaced apart by a predetermined gap. An inlet conduit is provided for supply gas to the first electrode. The conduit includes a nozzle for dispersing the gas in the shape of annular jet. A venturi housing is provided within the second electrode. An exhaust conduit is provided for discharging gas and residue from the housing. Gas is supplied through the nozzle in an annular shape and traverses the gap between the first and second electrodes to entrain low velocity gas within the housing thus decreasing the velocity of the gas supplied to the housing and increasing the diameter of the annular shape. The venturi disposed within the second electrode recirculates a large volume of gas to clean and cool the surface of the electrodes.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
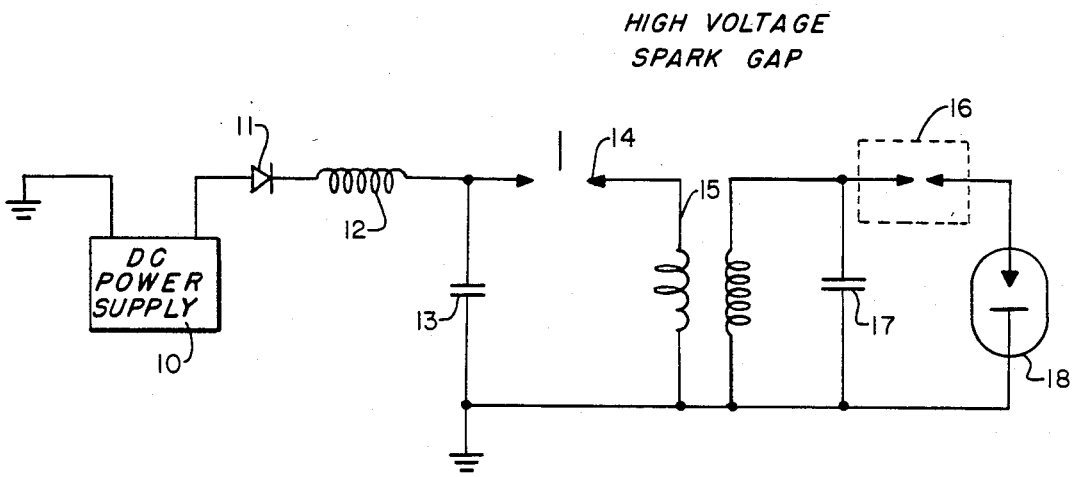
FIG. 1 is schematic view illustrating the basic repetitive pulser utilizing the high voltage spark gap of the present invention.

As illustrated in FIG. 1, a grounded DC power source 10 is connected in a circuit having a diode 11, and an inductor 12 positioned in series with each other. A capacitor 13 is positioned between the inductor 12 and the ground. A primary switch 14 is disposed between the transformer 15 and the inductor 12. A high voltage spark gap 16 is positioned between a pulse forming line (PFL) 17 and a diode 18.

The high voltage spark gap 16 is a gas insulated self-firing spark gap which operates in the megavolt range and is typically used at the output stages of a high voltage particle accelerator to switch the electrostatic energy stored on the PFL 17 through the machine's diode 18. The accelerator is repetitively pulsed at rates ranging from 1 to hundreds of pulses per second. Thus, the gas in the switch must completely recover its dielectric strength between pulses to withstand the subsequent PFL charge cycle voltage up to the self-fire level. The high voltage arc gap 16 permits break-over to occur at identically the same voltage on each pulse.

In general, to achieve stable spark gap operation it is necessary to flow fresh insulating gas through the switch volume at a rate sufficient to cool and carry away the products of the arc discharges. The pattern and the velocity of the gas flow through the high voltage spark gap 16 has a very pronounced effect upon the self-firing stability of the switch.

Conventional spark gaps often utilize vortex or direct radial flow patterns wherein a gas stream is introduced at or near the extreme inside diameter of the housing. The gas converges toward the center where it picks up ionization products before being exhausted through the center of one or both of the main electrodes. Conventional spark gaps typically require an air volume of 20 to 40 SCFM at pulse rates from 1 to 100 pps. The stability of such switches varies directly with the flow rate. Stability increases with an increase in the flow rate.

Figure 2:
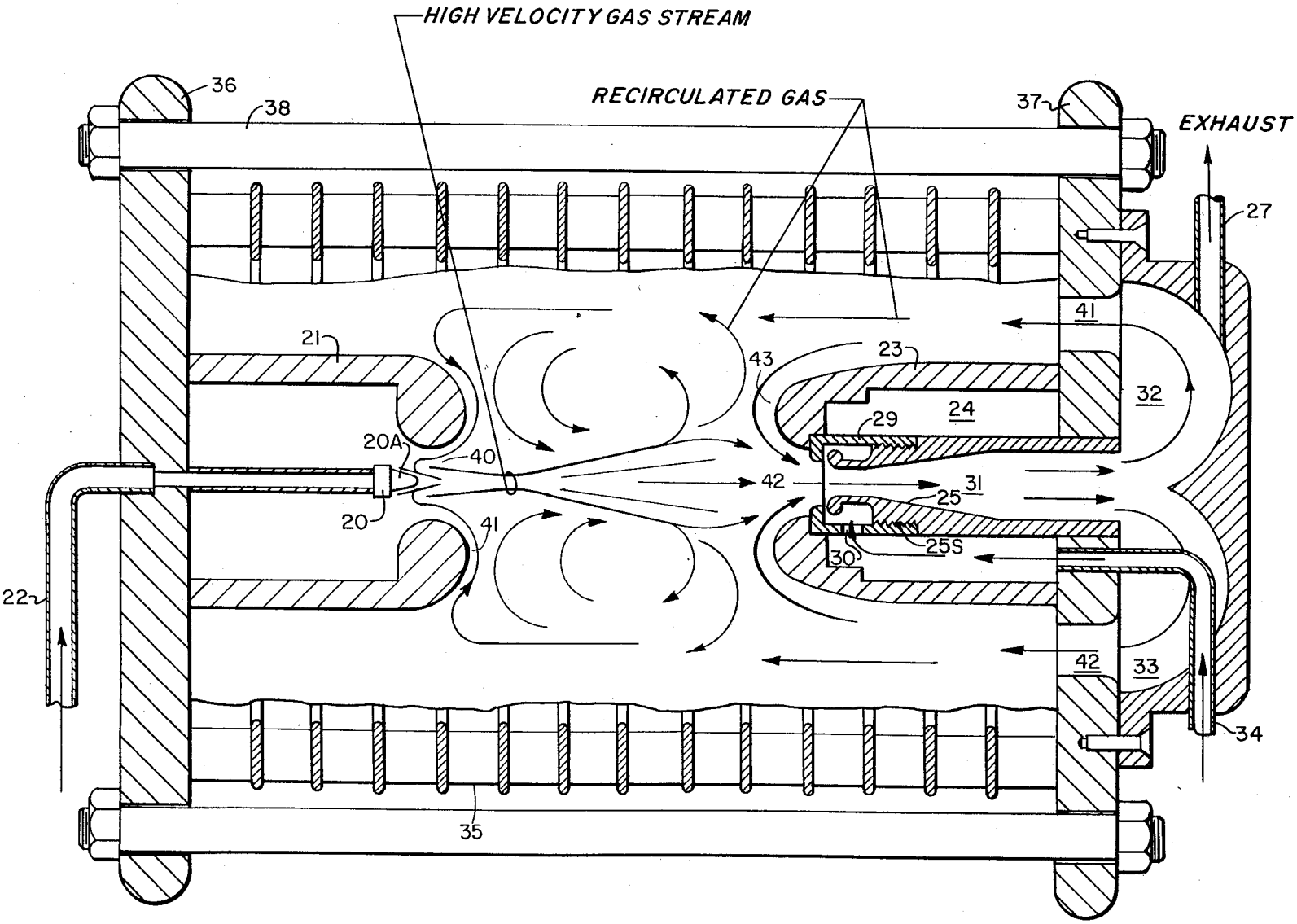
FIG. 2 is a partial cross-sectional view illustrating the high voltage spark gap of the present invention.

The internal components of the high voltage spark gap switch 16 are illustrated in FIG. 2. The switch 16 incorporates a unique high velocity reentrainment scavenging method which requires less than one fourth the volume of gas per stable switch operation. In view of the lower volume of gas required for stable switch operation proportionally less compressor power is required to supply the high pressure gas.

As illustrated in FIG. 2, a high velocity nozzle 20 is recessed within a first electrode 21 having an outer surface 41. A high pressure gas inlet conduit 22 is connected directly to the high velocity nozzle 20 for supplying gas thereto. Gas is dispersed from the nozzle 20 in an annular shape and at a high velocity through opening 40 in surface 41 towards the center of the switch 16 towards the opposite electrode 23. Tip 20A of nozzle 20 is spaced a predetermined distance inwardly of electrode 21 from surface 41. The opposite electrode 23 includes a surface 43 having an opening 42 aligned with opening 40 and communicating with a hollow center 24 in which a venturi housing 25 is operatively disposed.

As the high pressure gas dispersed from the nozzle 20 traverses the gap between the electrodes 21, 23, the high velocity gas stream entrains low velocity gas from the bulk volume between the electrodes. The entrainment of the gas causes the velocity of the high stream to decrease as it approaches the opposite electrode 23. The diameter of the stream also increases with the entrained gas so that only a part of the gas on or near the axis of the stream continues through the venturi housing 25 and out an exhaust conduit 27. The remaining gas impinges against the surface 43 of the electrode 23 and, due to the minute pressure differential set up by the entrainment action, reverses direction and is again drawn into the high speed stream. The flow pattern of the gas is illustrated by the arrows in FIG. 2. The process of internal reentrainment establishes an axisymmetric cylindrical eddy flow pattern between the electrodes 21 and 23 which produces vigorous mixing of the gas and cooling of the arc discharge products. The cooling and mixing action maintains a constant air quality between the electrodes 21, 23 which is essential to dielectric strength recovery and a precise breakdown characteristic.

The entrainment of the gas is enhanced by the suction venturi 25 disposed within the opening 24 in the electrode 23. The venturi housing 25 includes screw connection means 25S which mate with threaded portions on the receiving housing 29 which is connected directly to the electrode 23. The receiving housing 29 includes an opening 30 disposed at one end thereof. As illustrated in FIG. 2, the venturi housing 25 is spaced a short distance away from front of the receiving housing 29.

The venturi housing 25 includes an opening 31 disposed therein. The opening 31 receives gas from the gap between the electrodes 21, 23 and directs the gas to the chambers 32, 33. The gas within the chambers 32, 33 is redirected outwardly back towards the area of the gap between the electrodes 21 and 23.

A second source of high pressure gas 34 may be supplied directly to the opening 30 in the receiving member 29. The gas delivered through the high pressure gas conduit 34 passes through the small gap between the venturi housing 25 and the receiving member 29. As described herein, venturi 25 and the gas from second source 34 passing through opening 30 form a means for pumping the gas flow within switch 16.

An exhaust conduit 27 receives a quantity of gas directed to the chambers 32, 33 and the exhaust gas products of the arc discharge from the switch 16.

The switch 16 includes a housing 35 with end plates 36, 37 connected together by means of bolts 38. The housing provides an airtight chamber in which the high spark gap switch 16 is positioned.

The process of reentrainment of the gas is enhanced by the suction venturi 25 disposed within the exhaust electrode 23. When high pressure gas is supplied to the annular passage around the the throat of the venturi 25, a thin sheet of gas is projected radially inward at the mouth of the venturi. Boundary layer effects turn the high velocity radial gas stream in toward the throat of the venturi which draws additional gas from around the region of the output electrode 23. The radially injected gas plus the entrained volume are swept through the exhaust venturi opening 31 where the cross section and static pressure of the gas increases. From the exit of the venturi 25 the gas enters the directional reversal and exhaust chambers 32, 33. A volume equal to the input to both the high velocity nozzle 20 and the suction venturi is exhausted from this chamber. The remainder is returned to the main volume of the switch through ports 41, 42 disposed in the end plate 37. The returned gas is recirculated together with gas supplied through the high velocity nozzle 20.

The high velocity nozzle 20 reentrains a volume of has equal to nearly twice the input volume at the pressure and temperature conditions in the main switch volume. The suction venturi 25 amplifies the recirculation between the electrodes by drawing out a volume of the gas from the switch 16 greater than twice its input volume. The combination of the nozzle 20 and the suction venturi 25 can recirculate a volume up to four or five times the net input volume to the switch which reduces the external supply requirements by a corresponding amount.

Figures 3A, 3B:
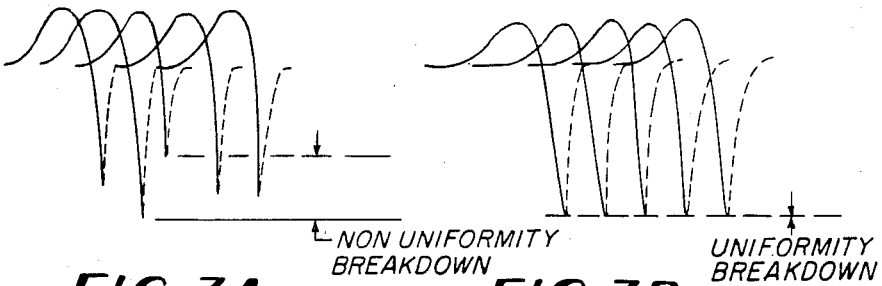
FIG. 3A illustrates switch breakdown with conventional vortex flow pattern wherein gas volume is 1040 SCFH.
FIG. 3B illustrates switch breakdown with reentrained gas flow wherein gas volume is 650 SCFH.

Switching performance is measurably improved with the rentrained gas flow. As illustrated in FIG. 3A, an oscilloscope record shows the successive charge voltage cycles when the switch was equipped with a conventional vortex flow pattern. The switch breakdown is illustrated with a conventional vortex flow pattern wherein the gas volume was 1040 SCFH.

FIG. 3B illustrates a similar oscilloscope record with the switch modified for reentrainment gas flow. The switch breakdown amplitude at the negative peak is much more uniform with the reentrained gas flow according to the present invention.

In the megavolt spark gap 16 it is highly desirable for the spark to move around on a pulse-to-pulse basis to equalize wear on the electrodes 21, 23. Stability, therefore, according to the present invention is defined as the characteristic of self-firing at the same voltage level shot after shot. The present invention incorporates a scavenging method for the the spark gap which accomplishes the constant switching characteristic.

The annular jet discharge gas from the nozzle 20 is illustrated in FIG. 2. A thin sheet is formed around the base of the cone tip 20A. The thin annular jet of high velocity gas has a surface area proportionally greater than a jet of uniform diameter passing an equivalent amount of gas. Since the mechanism of gas entrainment involves fluid shear coupling at the boundary between the fast and slow fluids, the annular jet entrains more gas and hence provides better mixing and cooling of the plasma products than a simple uniform jet. The volume of gas circulating between the main electrodes is thereby amplified by a factor of four to five over the volume injected through the nozzle 20.

Another superior feature of the recessed annular jet is that the primary mixing zone of the entrained gas is over the cone tip surface 20A inside the main electrode 21. With a simple uniform jet in the electrode face, according to a conventional mechanism, any gas mixing which occurs would take place some distance from the electrode surface. Consequently, the electrode is not as well cleaned and cooled with a simple jet.

The present invention provides a substantial improvement over a conventional simple jet. The recessed annular jet draws gas directly over the switching surface 41 of the electrode 21 where residual plasma products are mixed with cold gas before becoming transported back into the switching volume between the main electrodes 21, 23. The suction venturi 25 in the opposite electrode 23 produces the same sweeping and cooling action over surface 42.

The direct surface cleaning and cooling of the main electrodes in the megavolt spark gap is one of the two most important features of the gas flow design. The other is the amplified gas volume circulating between the electrodes 21, 23. The gas reversal chambers 32, 33 provide recirculation of a large fraction of the gas and produce an economy feature. The spark gap switch 16 must be cleaned and cooled between shots when there is no current or magnetic field available to drive the residual ionization free from the interior of the switch. The spark gap switch 16 is designed for transient repetitive switching of high current pulses, up to 100,000 amps. The improved scavenging efficiency performance of the reentrainment type high voltage switch 16 produces economical advantages for very large, multi megajoule, repetitive pulse machines. Such machines are proposed for fusion reactors which could with current technology require several thousand horsepower of auxiliary compressors to supply compressed gas for the spark gap switches 16. A reduction of four to five in the compressed gas demand could therefore amount to a substantial reduction in capital equipment and operating costs which have been estimated to be between $2.60/joule and $4.00/joule.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A high voltage spark gap switch comprising:

a housing including first an second end walls spaced apart by a predetermined distance;

a hollow first electrode positioned on said first end wall, said electrode having a first outer surface and a first annular opening;

means for supplying gas to said housing through said first annular opening, said means including a gas inlet conduit and a nozzle, said nozzle having a tip located a predetermined distance inwardly from said first outer surface; a second electrode positioned on said second end wall and spaced from said first electrode by a predetermined gap, said second electrode having a second surface defining a second annular opening operatively aligned with said first annular opening for receiving gas from said first annular opening;

means for pumping the gas flowing within said housing;

means for recirculating a portion of the pumped gas flow through said housing, said flow being entrained by the gas from said first annular opening in cylindrical flow patterns, the flow patterns passing over each of said first and second surfaces; and means for exhausting the remaining portion of said pumped gas flow.

2. A high voltage spark gap switch according to claim 1, wherein said nozzle includes a cone tip for dispersing the gas as a thin annular jet of high velocity having a large surface area.

3. A high voltage spark gap switch according to claim 1 wherein said second electrode is hollow, said means for pumping being disposed directly within said electrode and being spaced a predetermined distance inwardly from said second surface of said second electrode.

4. A high voltage spark gap switch according to claim 3 wherein said means for recirculating comprises at least one recirculating chamber positioned rearwardly of said second electrode for reversing the flow of gas exiting from said means for pumping.

5. A high voltage spark gap switch according to claim 4, wherein said exhaust conduit means is in communication with said recirculating chamber.

6. A high voltage spark gap switch according to claim 3 wherein said means for pumping comprises:

a venturi housing having a housing opening extending between an input end for receiving gas passing through said second opening of said second electrode and an output end for supplying gas to said means for recirculating, said passage having a narrower throat portion than said input and output ends; and a second inlet conduit having a first end connectable to a source of high pressure gas and second end means for supplying gas from said source along said throat of said venturi housing.

* * * * *